US005551091A

United States Patent [19]

Tyndall

[11] Patent Number: 5,551,091

[45] Date of Patent: Sep. 3, 1996

[54] TROUSERS WITH INTEGRAL SEATING COMPONENTS

[76] Inventor: Rick J. Tyndall, 1721 N. Amber Rd., Scottville, Mich. 49454

[21] Appl. No.: 327,603

[22] Filed: Oct. 24, 1994

[51] Int. Cl.[6] ..... A41D 1/06

[52] U.S. Cl. ..... 2/227; 2/228

[58] Field of Search ..... 2/227, 228, 238, 2/79, 69, 242, 214

[56] References Cited

U.S. PATENT DOCUMENTS

| | | | |
|---|---|---|---|
| 4,035,844 | 7/1977 | Atack et al. | 2/227 |
| 4,470,156 | 9/1984 | Duerbeck et al. | 2/227 |
| 4,561,124 | 12/1985 | Thompson | 2/227 |
| 4,613,991 | 9/1986 | Grover | 2/227 |
| 4,843,654 | 7/1989 | March | 2/227 |
| 4,894,867 | 1/1990 | Ceravolo et al. | 2/227 |
| 4,922,551 | 5/1990 | Anthes | 2/227 |
| 5,038,408 | 8/1991 | Debaene | 2/227 |
| 5,050,244 | 9/1991 | Kleinman | 2/227 |
| 5,068,920 | 12/1991 | Bray | 2/227 |
| 5,105,473 | 4/1992 | Valtakari | 2/227 |

*Primary Examiner*—C. D. Crowder
*Assistant Examiner*—Gloria Hale

[57] ABSTRACT

Trousers with integral seating components comprising short trousers having an upper end formed as a loop for the receipt of a wearer's torso, a lower end formed as a pair of small loops for the receipt of a wearer's legs above the knee and with legs formed therebetween; an arcuate inseam coupling the legs at their upper extent and the upper portion of the trouser, an enlarged opening in the front area of the trousers immediately above the inseam and immediately above the upper edge and extending laterally from the majority of the front area thereof; the trousers being fabricated of a flexible compressed foam, such as styrofoam or foam rubber, with a layer of waterproof material therearound internally and externally and an insulating fiber mat between the external layer internally and the foam material; and a plurality of strips of flexible plastic inserts in the form of parallelograms interior of the compressed foam on the rear face of each leg and extending upwardly to a lower extent of the upper portion of the trousers with stitching therearound to hold the inserts in place.

6 Claims, 3 Drawing Sheets

TROUSERS WITH INTEGRAL SEATING COMPONENTS

BACKGROUND OF THE INVENTION

1. Field of the Invention

The present invention relates to new and improved trousers with integral seating components and, more particularly, pertains to increasing the comfort of outdoors people when sitting in an otherwise uncomfortable area through the use of padded short pants with integral rods formed in the back side.

2. Description of the Prior Art

The use of outdoor garments and equipment of a wide variety of designs and constructions to achieve a wide variety of purposes is known in the prior art. More specifically, outdoor garments and equipment of a wide variety of designs and constructions to achieve a wide variety of purposes heretofore devised and utilized for the purpose of promoting the comfort of outdoors people through the use of equipment and apparel designed for such purposes are known to consist basically of familiar, expected, and obvious structural configurations, notwithstanding the myriad of designs encompassed by the crowded prior art which has been developed for the fulfillment of countless objectives and requirements.

The prior art discloses a large number of outdoor garments and equipment of a wide variety of designs and constructions to achieve a wide variety of purposes. By way of example, U.S. Pat. No. 3,451,064 to Dolan discloses a trousers type garment with seat and ground engaging support.

U.S. Pat. No. 3,536,512 to Dolan discloses trousers with associated ground engaging improved support.

U.S. Pat. No. 5,038,408 to DeBaene discloses work pants.

Lastly, U.S. Pat. No. 5,186,372 to Biedenhard discloses a combination backpack and stool.

In this respect, the trousers with integral seating components according to the present invention substantially depart from the conventional concepts and designs of the prior art, and in doing so provide an apparatus primarily developed for the purpose of increasing the comfort of outdoors people when sitting in an otherwise uncomfortable area through the use of padded short pants with integral rods formed in the back side.

Therefore, it can be appreciated that there exists a continuing need for new and improved trousers with integral seating components which can be used for increasing the comfort of outdoors people when sitting in an otherwise uncomfortable area through the use of padded short pants with integral rods formed in the back side. In this regard, the present invention substantially fulfills this need.

SUMMARY OF THE INVENTION

In view of the foregoing disadvantages inherent in the known types of outdoor garments and equipment of a wide variety of designs and constructions to achieve a wide variety of purposes now present in the prior art, the present invention provides new and improved trousers with integral seating components. As such, the general purpose of the present invention, which will be described subsequently in greater detail, is to provide new and improved trousers with integral seating components and methods which have all the advantages of the prior art and none of the disadvantages.

To attain this, the present invention essentially comprises new and improved trousers with integral seating components comprising, in combination, short trousers having an upper end formed as a loop for the receipt of a wearer's torso, a lower end formed as a pair of small loops for the receipt of a wearer's legs above the knee and with legs formed therebetween; an arcuate inseam coupling the legs at their upper extent and the upper portion of the trouser, an enlarged opening in the front area of the trousers immediately above the inseam and immediately above the upper edge and extending laterally from the majority of the front area thereof; large patch pockets formed on the sides of the trousers with upper edges adjacent to a central elevation thereof; a plurality of belt loops secured to the trousers immediately beneath the upper opening thereof; snap fasteners at the upper edge in the front center thereof for the selective opening and closing of the trousers; a heavy reinforcement material secured around the upper edge of the garment; the trousers being fabricated of a flexible compressed foam, such as styrofoam or foam rubber, with a layer of waterproof material therearound internally and externally and an insulating fiber mat between the external layer internally and the foam material; and a plurality of strips of flexible plastic inserts in the form of parallelograms interior of the compressed foam on the rear face of each leg and extending upwardly to a lower extent of the upper portion of the trousers with stitching therearound to hold the inserts in place.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved trousers with integral seating components which have all the advantages of the prior art outdoor garments and equipment of a wide variety of designs and constructions to achieve a wide variety of purposes and none of the disadvantages.

It is another object of the present invention to provide new and improved trousers with integral seating components which may be easily and efficiently manufactured and marketed.

It is a further object of the present invention to provide new and improved trousers with integral seating components which are of a durable and reliable construction.

An even further object of the present invention is to provide new and improved trousers with integral seating components which are susceptible of a low cost of manufacture with regard to both materials and labor, and which accordingly are then susceptible of low prices of sale to the consuming public, thereby making such trousers with integral seating components economically available to the buying public.

Still yet another object of the present invention is to provide new and improved trousers with integral seating components which provide in the apparatuses and methods of the prior art some of the advantages thereof, while simultaneously overcoming some of the disadvantages normally associated therewith.

Even still another object of the present invention is to increase the comfort of outdoors people when sitting in an otherwise uncomfortable area through the use of padded short pants with integral rods formed in the back side.

Lastly, it is an object of the present invention to provide trousers with integral seating components comprising short trousers having an upper end formed as a loop for the receipt of a wearer's torso, a lower end formed as a pair of small loops for the receipt of a wearer's legs above the knee and with legs formed therebetween; an arcuate inseam coupling the legs at their upper extent and the upper portion of the trouser, an enlarged opening in the front area of the trousers immediately above the inseam and immediately above the upper edge and extending laterally from the majority of the front area thereof; the trousers being fabricated of a flexible compressed foam, such as styrofoam or foam rubber, with a layer of waterproof material therearound internally and externally and an insulating fiber mat between the external layer internally and the foam material; and a plurality of strips of flexible plastic inserts in the form of parallelograms interior of the compressed foam on the rear face of each leg and extending upwardly to a lower extent of the upper portion of the trousers with stitching therearound to hold the inserts in place.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
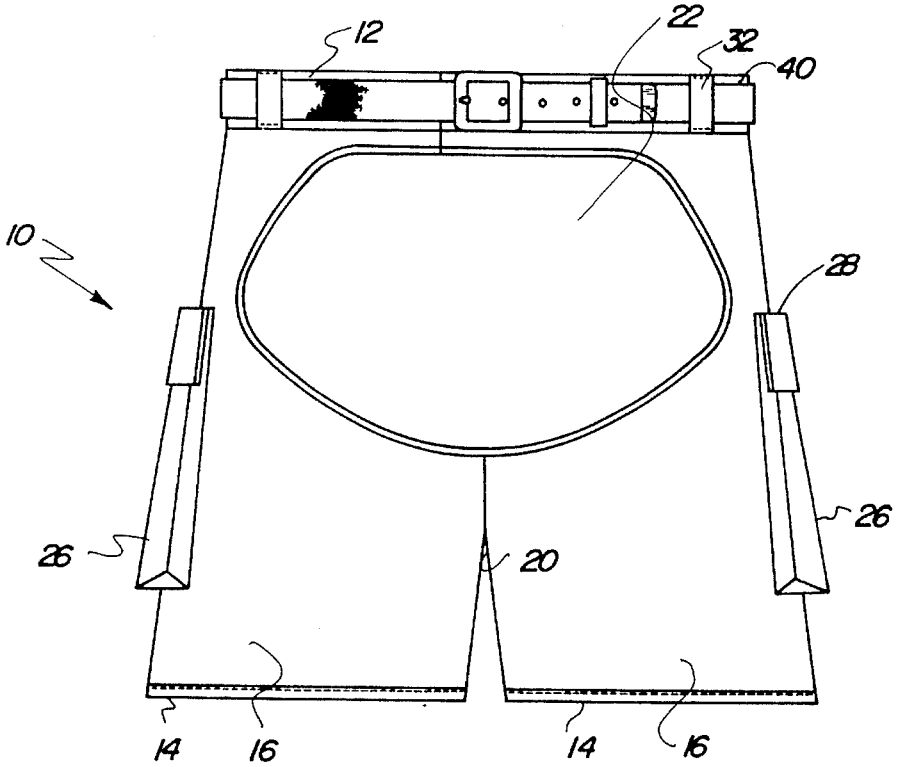
FIG. 1 is a front elevational view of the preferred embodiment of the new and improved trousers with integral seating components constructed in accordance with the principles of the present invention.
Figure 2:
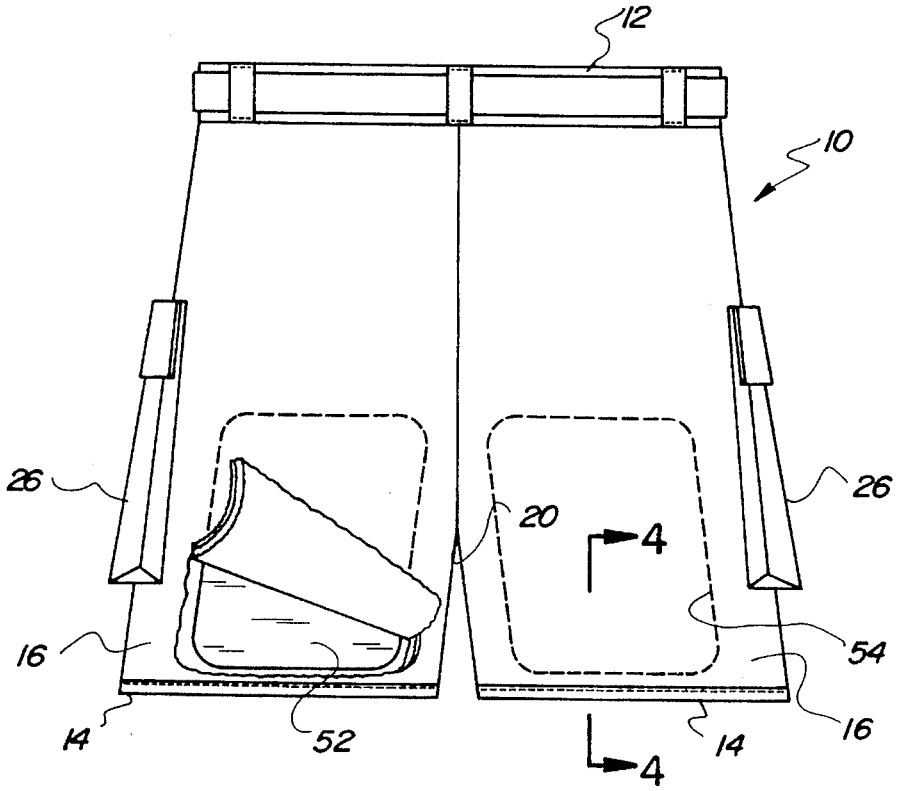
FIG. 2 is a rear elevational view of the garment shown in FIG. 1.
Figure 3:
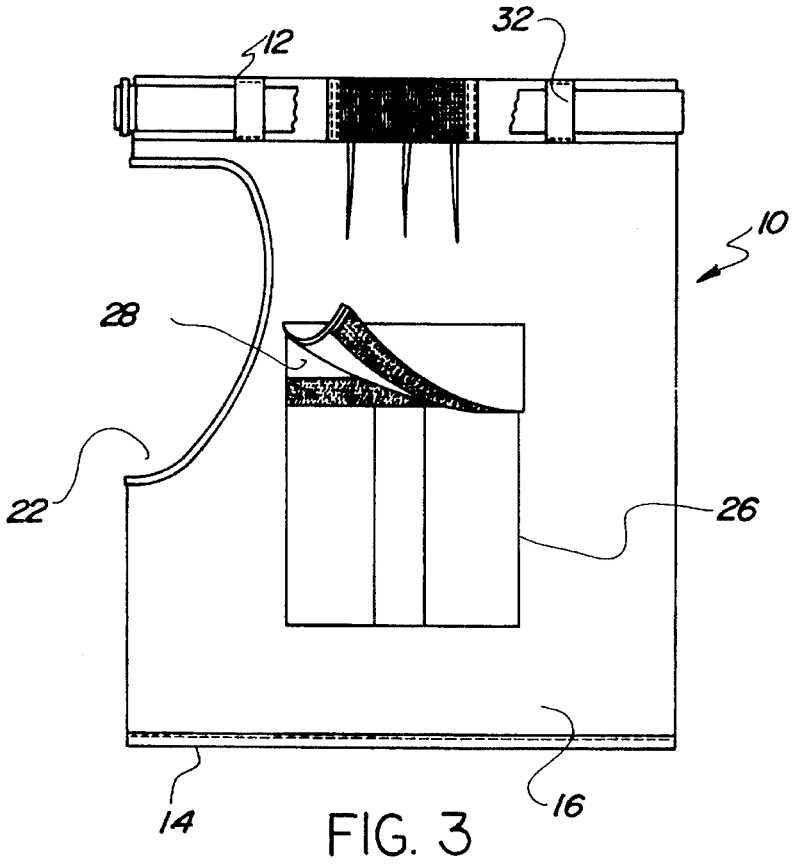
FIG. 3 is a side elevational view of the garment shown in FIGS. 1 and 2.
Figure 4:
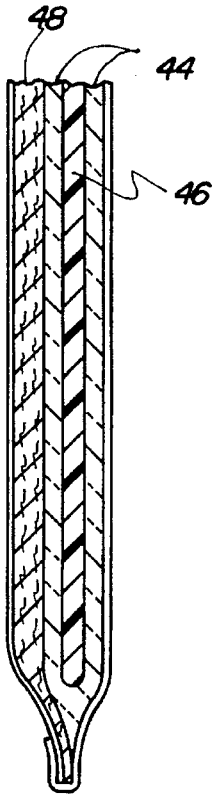
FIG. 4 is a cross-sectional view taken along line 4—4 of FIG. 2.
Figure 5:
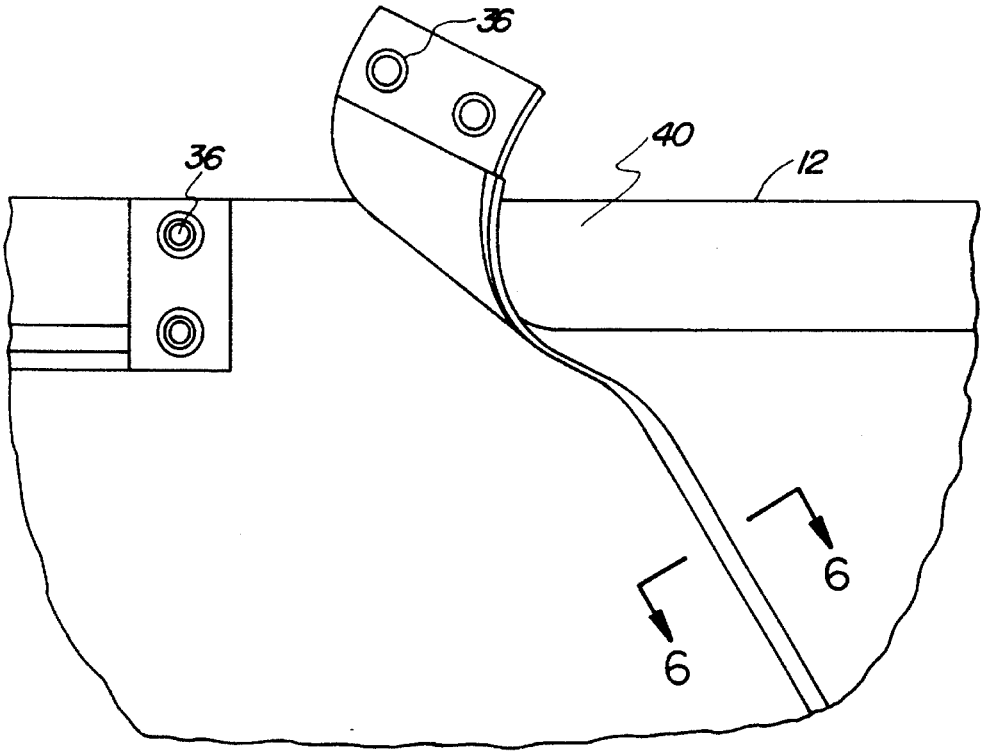
FIG. 5 is an enlarged side elevational view of an upper side portion of the garment of the prior Figures.
Figure 6:
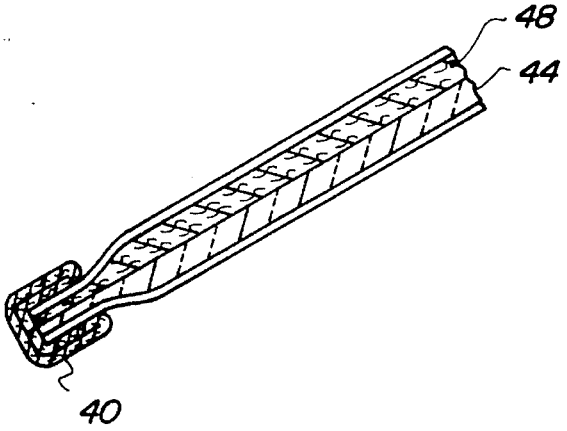
FIG. 6 is a cross-sectional view taken along line 6—6 of FIG. 5.

With reference now to the drawings, and in particular to FIG. 1 thereof, the preferred embodiment of the new and improved trousers with integral seating components embodying the principles and concepts of the present invention and generally designated by the reference numeral 10 will be described.

The present invention, the new and improved trousers with integral seating components is a system 10 comprised of a plurality of components. Such components, in their broadest context, include short trousers, an arcuate inseam, large patch pockets, belt loops, fasteners, reinforcement material and specific materials for the various regions of the garment. Each of the individual components is specifically configured and correlated one with respect to the other so as to attain the desired objectives.

The present invention, the new and improved trousers with integral seating components, is trousers which constitute a system 10 thereformed with integral seating components. The primary component is the short trousers 10. Such short trousers have an upper end 12 formed as a loop for the receipt of a wearer's torso. The short trousers also have a lower end 14 formed as a pair of small loops for the receipt of a wearer's legs above the knees. The legs 16 are formed therebetween.

The short trousers include an arcuate inseam 20. Such inseam couples the legs at their upper extent and the upper portion of the trousers. An enlarged opening 22 is located in the front area of the trousers. This is immediately above the inseam and immediately above the upper edge. It extends laterally for the majority of the front area of the trousers.

Large patch pockets 26 are provided. They are formed on the sides of the trousers with upper edges 78. The upper edges of the pockets are adjacent to a central elevation of the trousers.

Belt loops 32 are also provided on the trousers. Such loops are a plurality in number spaced around the upper periphery. They are secured individually to the trousers between the upper opening of the trousers. Snap fasteners 36 are located at the upper edge of the trousers. These are in the front center of the trousers. They are for the selectively opening and closing of the trousers.

Reinforcement material 40 of a heavy construction are also provided. Such reinforcement material is secured around the upper edge of the garment and at the various seams throughout the garment.

From a structural standpoint, the trousers are fabricated of a flexible compressed foam 44. Styrofoam or foam rubber is a suitable material for such foam. A layer of waterproof material 46 is located around the compressed foam. It is located both internally and externally of the foam. In addition, an insulating fiber mat 48 is located between the external layer internally and the foam material externally.

Next provided are a plurality of strips 52 of flexible plastic inserts. Such inserts are located in the form of parallelograms. They are located interior of the compressed foam on the rear face of each leg. This is in the area where a user would sit. They extend upwardly to a lower extent of the upper portion of the trousers. Stitching 54 is located around the inserts to hold the inserts in place.

The present invention comprises oversized shorts that will be worn over other clothing. This invention will allow outdoorsmen to sit comfortably anywhere. The flexible compressed foam rubber or styrofoam lining will cushion rough surfaces such as rocks, sticks, or other pointed objects. Ice fishermen will have a warm comfortable seat, sitting on an ordinary bucket. The pants will always be warm and soft with the loft of the insulating material. Whether one sits on wet snow or is duck hunting in the rain, the water repellent outer shell will insure the outdoorsman will remain dry on the inside. This invention should appeal to bow hunters, gun hunters, ice fishermen, turkey hunters and even football fans sitting on bleachers.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. Trousers with integral seating components comprising, in combination:

short trousers having an upper end formed as a loop for the receipt of a wearer's torso, a lower end formed as a pair of small loops for the receipt of a wearer's legs above the knee and with legs formed therebetween;

an arcuate inseam coupling the trouser legs at an upper extent of the wearer's legs and an upper portion of the trouser, an enlarged opening in a front area of the trousers immediately above the inseam and immediately below the upper end of the trousers and extending laterally from a majority of the front area thereof;

large patch pockets formed on sides of the trousers with upper edges thereof adjacent to a central elevation of the trousers;

a plurality of belt loops secured to the trousers immediately between an upper opening of the trousers;

snap fasteners at the upper end in the front center thereof for the selective opening and closing of the trousers;

a heavy reinforcement material secured around the upper end of the garment;

the trousers being fabricated of multiple layers of flexible compressed foam with a layer of waterproof material between the foam layers and with an insulating fiber material internally of an external foam layer; and a plurality of strips of flexible plastic inserts in the form of parallelograms interior of the compressed foam on the rear face of each leg and extending upwardly to a lower extent of an upper portion of the trousers with stitching therearound to hold the inserts in place.

2. Trousers with integral seating components comprising:

short trousers having an upper end formed as a loop for the receipt of an wearer's torso, a lower end formed as a pair of small loops for the receipt of a wearer's legs above the knee and with legs formed therebetween;

an arcuate inseam coupling the trouser legs at an upper extent of the wearer's legs and an upper portion of the trouser, an enlarged opening in a front area of the trousers immediately above the inseam and immediately below the upper end of the trousers and extending laterally from a majority of the front area thereof;

the trousers being fabricated of multiple layers of flexible compressed foam with a layer of waterproof material between the foam layers and with an insulating fiber material internally of an external foam layer; and a plurality of strips of flexible plastic inserts in the form of parallelograms interior of the compressed foam on the rear face of each leg and extending upwardly to a lower extent of an upper portion of the trousers with stitching therearound to hold the inserts in place.

3. The garment as set forth in claim 2 and further including:

large patch pockets formed on sides of the trousers with upper edges thereof adjacent to a central elevation of the trousers.

4. The garment as set forth in claim 2 and further including:

a plurality of belt loops secured to the trousers immediately between an upper opening of the trousers.

5. The garment as set forth in claim 2 and further including:

snap fasteners at the upper end in the front center thereof for the selective opening and closing of the trousers.

6. The garment as set forth in claim 2 and further including:

a heavy reinforcement material secured around the upper end of the garment.

* * * * *